US008267736B2

(12) United States Patent
Lam

(10) Patent No.: US 8,267,736 B2
(45) Date of Patent: Sep. 18, 2012

(54) ANIMAL BUBBLE ASSEMBLY

(75) Inventor: Darren Lam, Hong Kong (HK)

(73) Assignee: Placo Bubbles Limited, Hong Kong (HK)

( * ) Notice: Subject to any disclaimer, the term of this patent is extended or adjusted under 35 U.S.C. 154(b) by 190 days.

(21) Appl. No.: 12/800,760

(22) Filed: May 21, 2010

(65) Prior Publication Data

US 2011/0287685 A1 Nov. 24, 2011

(51) Int. Cl.
*A63H 33/28* (2006.01)
*A63H 33/00* (2006.01)

(52) U.S. Cl. ..... 446/19

(58) Field of Classification Search ..... 446/15–21
See application file for complete search history.

(56) References Cited

U.S. PATENT DOCUMENTS

| | | | |
|---|---|---|---|
| 430,095 | A | 6/1890 | Thain |
| 616,239 | A | 12/1898 | King |
| 2,041,423 | A | 5/1936 | Mausolf |
| 2,213,391 | A | 9/1940 | Gamble |
| 2,225,702 | A | 12/1940 | Lyon, Jr. |
| 2,396,433 | A | 3/1946 | Pimblett |
| 2,412,732 | A | 12/1946 | Holman |
| 2,527,935 | A | 10/1950 | Joel, II |
| 2,547,825 | A | 4/1951 | King |
| 2,560,582 | A | 7/1951 | Limber |
| 2,587,537 | A | 2/1952 | Scott |
| 2,606,396 | A | 8/1952 | Hill |
| 2,632,281 | A | 3/1953 | Schmidt, Jr. |
| 2,659,177 | A | 11/1953 | Kopf |
| 2,700,845 | A | 2/1955 | Arliss |
| 2,711,051 | A | 6/1955 | Pick |
| 2,736,988 | A | 3/1956 | Fisher |
| D185,805 | S | 8/1959 | Clark |
| 2,974,438 | A | 3/1961 | Hopkins |
| 2,987,847 | A | 6/1961 | Jones |
| 3,008,263 | A | 11/1961 | Ellman |
| 3,071,888 | A | 1/1963 | Knott |
| 3,100,947 | A | 8/1963 | Hellman |
| 3,109,255 | A | 11/1963 | Hein |
| 3,228,136 | A | 1/1966 | Rouse |
| 3,323,250 | A | 6/1967 | Gibbons |
| 3,420,412 | A | 1/1969 | Greene |
| 3,485,408 | A | 12/1969 | Binesch |
| 3,579,898 | A | 5/1971 | Hein |
| 3,601,313 | A | 8/1971 | Berg |
| 3,604,144 | A | 9/1971 | Span |
| 3,731,412 | A | 5/1973 | Winslow |
| 3,736,694 | A | 6/1973 | Lebensfeld |

(Continued)

OTHER PUBLICATIONS

Little Tikes "Bubble Bellies", 2005 The little Tikes Company distributed by Imperial Toy Corp., Los Angeles, CA 90021.

*Primary Examiner* — Kien Nguyen
(74) *Attorney, Agent, or Firm* — Raymond Sun

(57) ABSTRACT

A bubble generating assembly has a head section having a bubble generator associated therewith, a body housing and a feet section that is configured as a reservoir for holding bubble solution. The body housing houses a motor and an air generator coupled to the motor, the outer surface of the body housing defining a handle for the assembly, and having an actuator provided on the outer surface of the body housing. A pump system is provided inside the body housing, and draws bubble solution from the feet section to the bubble generator.

18 Claims, 9 Drawing Sheets

U.S. PATENT DOCUMENTS 3,818,627 A 6/1974 Lebensfeld
3,845,583 A 11/1974 Ziff
3,913,260 A 10/1975 Corbett
3,925,923 A 12/1975 La Fata et al.
3,952,447 A 4/1976 Hackell
4,246,717 A 1/1981 Wachtel
4,300,612 A 11/1981 Schroeder et al.
D263,062 S 2/1982 Rasmussen
4,423,565 A 1/1984 Bart
4,438,955 A 3/1984 Ryan
4,447,982 A 5/1984 Gushea
4,467,552 A 8/1984 Jernigan
4,481,731 A 11/1984 La Fata et al.
4,603,021 A 7/1986 Urso
4,700,965 A 10/1987 Kinberg
4,711,363 A 12/1987 Marino
4,724,977 A 2/1988 Cleevely et al.
4,775,348 A 10/1988 Collins
4,804,346 A 2/1989 Sheng
RE32,973 E 7/1989 Panzarella
4,861,303 A 8/1989 Mong-Sheng
4,874,103 A 10/1989 Quisenberry et al.
D304,466 S 11/1989 Brown
4,957,464 A 9/1990 Perez
4,988,319 A 1/1991 Sheng
5,035,665 A 7/1991 Sheng
5,105,975 A 4/1992 Patterson
5,230,648 A 7/1993 Kelley et al.
5,234,129 A 8/1993 Lau
5,259,538 A 11/1993 Tardif
5,265,757 A 11/1993 Wu
5,273,172 A 12/1993 Rossbach et al.
5,304,085 A 4/1994 Novak
5,361,934 A 11/1994 Spence, Jr.
5,395,274 A 3/1995 Myers
3,183,621 A 5/1995 Allen, Jr.
5,462,469 A 10/1995 Lei
5,465,866 A 11/1995 Belcastro
5,498,191 A 3/1996 DeMars
5,509,551 A 4/1996 Terrell, II
5,513,762 A 5/1996 Janani
5,520,564 A 5/1996 DeMars
5,542,869 A 8/1996 Petty
5,579,948 A 12/1996 Lin
5,582,333 A 12/1996 Bennett
5,607,086 A 3/1997 Gooch
5,613,890 A 3/1997 DeMars
5,653,620 A 8/1997 Lin
5,695,379 A 12/1997 Ho
5,702,020 A 12/1997 Larsen
5,832,969 A 11/1998 Schramm
5,839,936 A 11/1998 Lin
5,842,899 A 12/1998 Cernansky et al.
5,850,945 A 12/1998 Frankel
RE36,131 E 3/1999 Schramm
5,879,218 A 3/1999 Tao
5,897,013 A 4/1999 Manganillo
6,050,433 A 4/2000 Russell et al.
6,062,935 A 5/2000 Gross
6,102,764 A 8/2000 Thai
6,132,125 A 10/2000 Lin
6,135,842 A 10/2000 La Fata
6,139,391 A 10/2000 Thai
6,149,486 A 11/2000 Thai
6,170,719 B1 1/2001 Wilkinson et al.
6,200,184 B1 3/2001 Rich et al.
6,315,627 B1 11/2001 Thai
6,331,130 B1 12/2001 Thai
6,343,712 B1 2/2002 Flackett et al.
6,416,377 B1 7/2002 Bart
6,447,356 B1 9/2002 Lapointe
6,530,815 B1 3/2003 Bro et al.
6,544,091 B1 4/2003 Thai
6,547,622 B2 4/2003 Thai
6,595,822 B1 7/2003 Thai
6,620,016 B1 9/2003 Thai
6,638,131 B1 10/2003 Thai
6,659,830 B2 12/2003 Thai
6,682,570 B2 1/2004 Thai
6,755,710 B2 6/2004 Thai
7,144,291 B2 12/2006 Thai
7,172,484 B2 2/2007 Thai
7,182,665 B2 2/2007 Thai
7,223,149 B2 5/2007 Thai
7,470,165 B2 * 12/2008 Ivanic et al. ..... 446/15
2002/0061697 A1 5/2002 Hornsby et al.

* cited by examiner

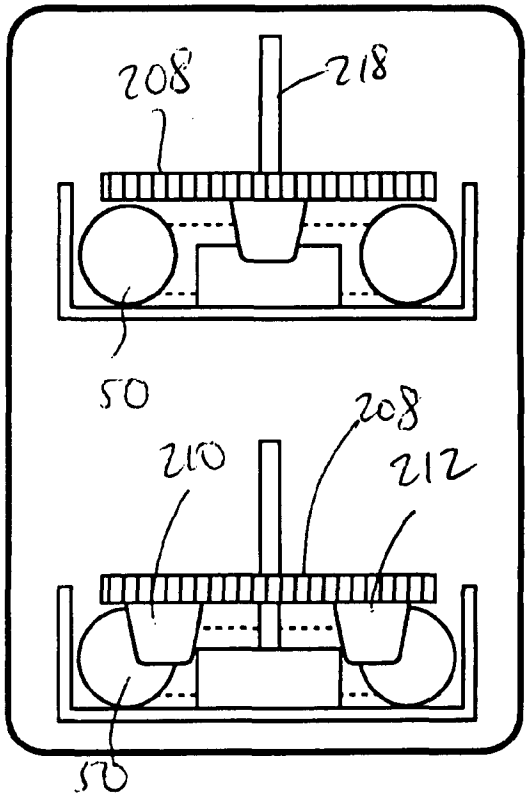
FIG 10A
FIG 10B
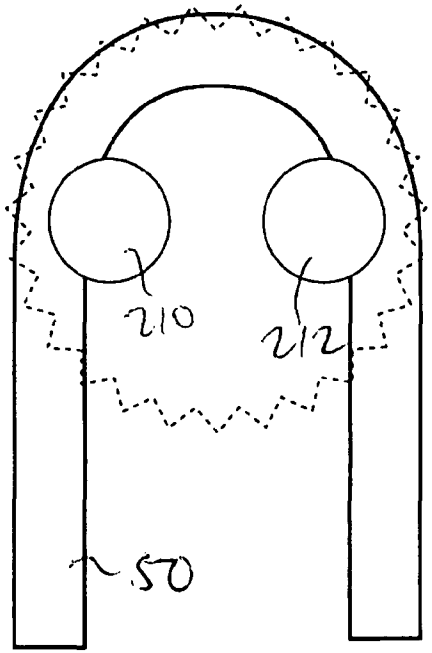
FIG. 11B
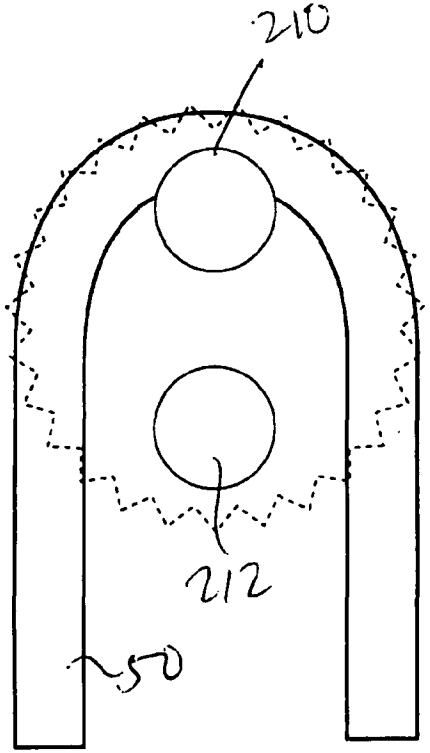
FIG. 11A

ANIMAL BUBBLE ASSEMBLY

BACKGROUND OF THE INVENTION

1. Field of the Invention

The present invention relates to bubble toys, and in particular, to a bubble generating assembly which is shaped as an animal, has a small and compact configuration, is convenient to use, and effectively produces streams of bubbles.

2. Description of the Prior Art

Bubble producing toys are very popular among children who enjoy producing bubbles of different shapes and sizes. Many bubble producing toys have previously been provided. Recently, many bubble generating assemblies have been provided where a film of bubble solution is formed across a bubble ring without the need to dip the bubble ring into a dish of bubble solution. A stream of air is directed towards the film of bubble solution to generate a stream of bubbles. Examples of such bubble generating assemblies are shown in U.S. Pat. Nos. 7,223,149 (Thai), 6,682,570 (Thai), 6,755,710 (Thai), 7,144,291 (Thai), 7,182,665 (Thai) and 7,172,484 (Thai), among others. Most of these assemblies include a pump system which delivers bubble solution from a bubble source (e.g., a bottle) to the bubble ring, a linkage that moves a component (either a stationary bar or the bubble ring itself) to form a film of bubble across the bubble ring, and an actuator that turns on a fan to direct the stream of air at the film of bubble solution.

While these bubble generating assemblies have been effective in producing streams of large and small bubbles, and in bringing considerable entertainment and fun to children, they still suffer from certain drawbacks. For example, some of these assemblies are quite large in size because of the intricate linkages and pump system that are needed to produce the bubbles. In addition, some of these bubble assemblies are not easy to use, especially for younger children. Moreover, some of these bubble assemblies require that the bubble solution container be screwed or otherwise connected to the housing of the bubble assembly, which can be aesthetically unattractive and adds to the size and weight of the bubble assembly.

Reducing the size of the bubble assembly, and enhancing the convenience of use, will allow younger children to enjoy the benefits of the bubble assembly since a smaller bubble assembly can be carried around more easily. In addition, eliminating the need to attach a bubble solution container to the housing will lighten the weight and reduce the size of the bubble assembly. However, these objectives must be accomplished while still ensuring that bubbles can be produced effectively, and while finding a clean and secure storage for the bubble solution when the bubble assembly is being carried around.

SUMMARY OF THE DISCLOSURE

The objectives of the present invention are accomplished by providing a bubble generating assembly having a head section having a bubble generator associated therewith, a body housing and a feet section that is configured as a reservoir for holding bubble solution. The body housing houses a motor and an air generator coupled to the motor, the body housing defining a handle for the assembly, and having an actuator provided on the outer surface of the body housing. A pump system is provided inside the body housing, and draws bubble solution from the feet section to the bubble generator.

BRIEF DESCRIPTION OF THE DRAWINGS

FIGS. 10A and 10B are side views illustrating the operation of the pump system of FIG. 9.

FIGS. 11A and 11B are top plan views illustrating the operation of the pump system of FIG. 9.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
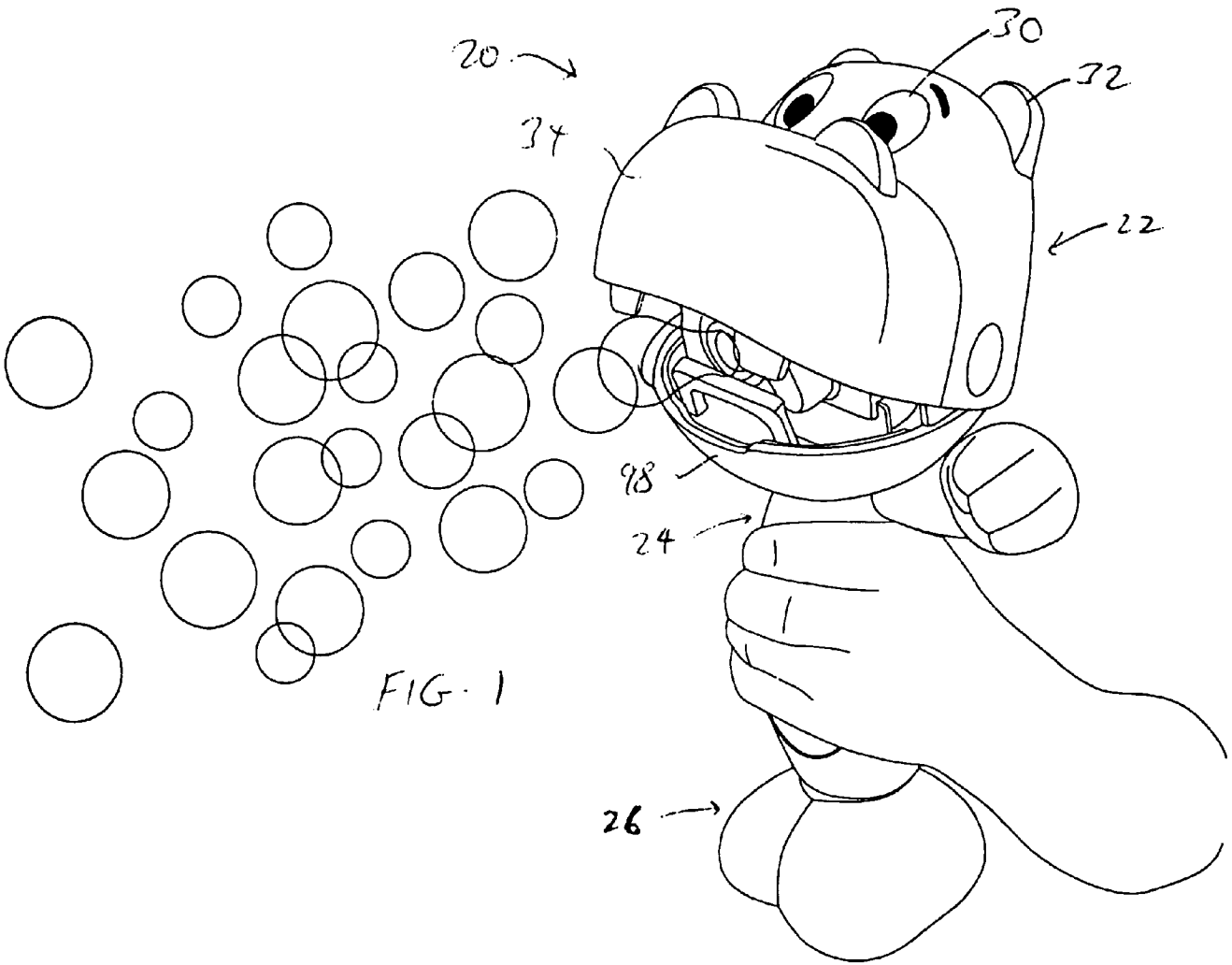
FIG. 1 is a front perspective view of a bubble generating assembly according to one embodiment of the present invention shown producing a plurality of bubbles.
Figures 2, 3:
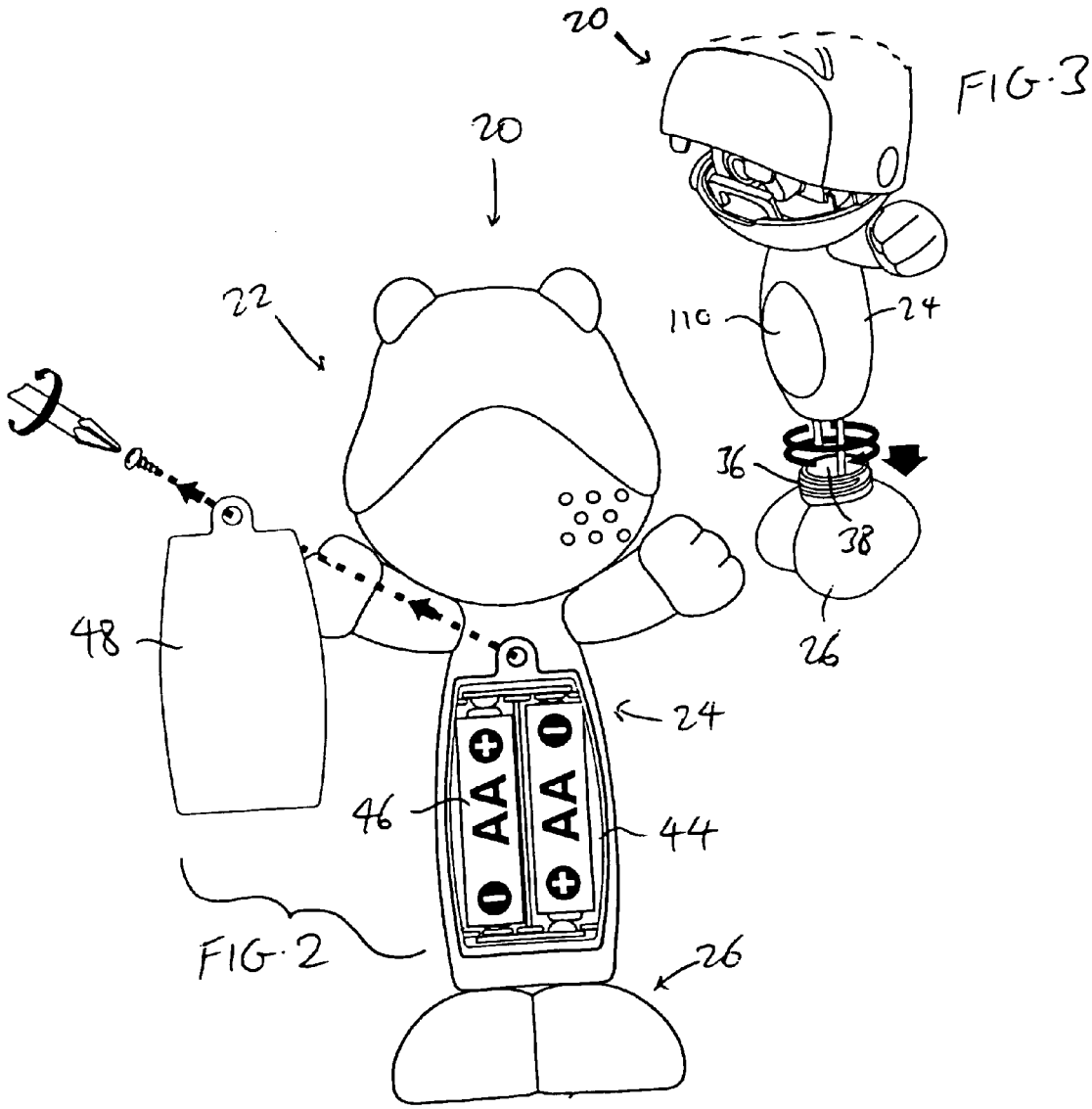
FIG. 2 is an exploded rear view of the assembly of FIG. 1.
FIG. 3 is partial perspective view of the assembly of FIG. 1 showing the feet section being detached from the body housing.
Figure 4:
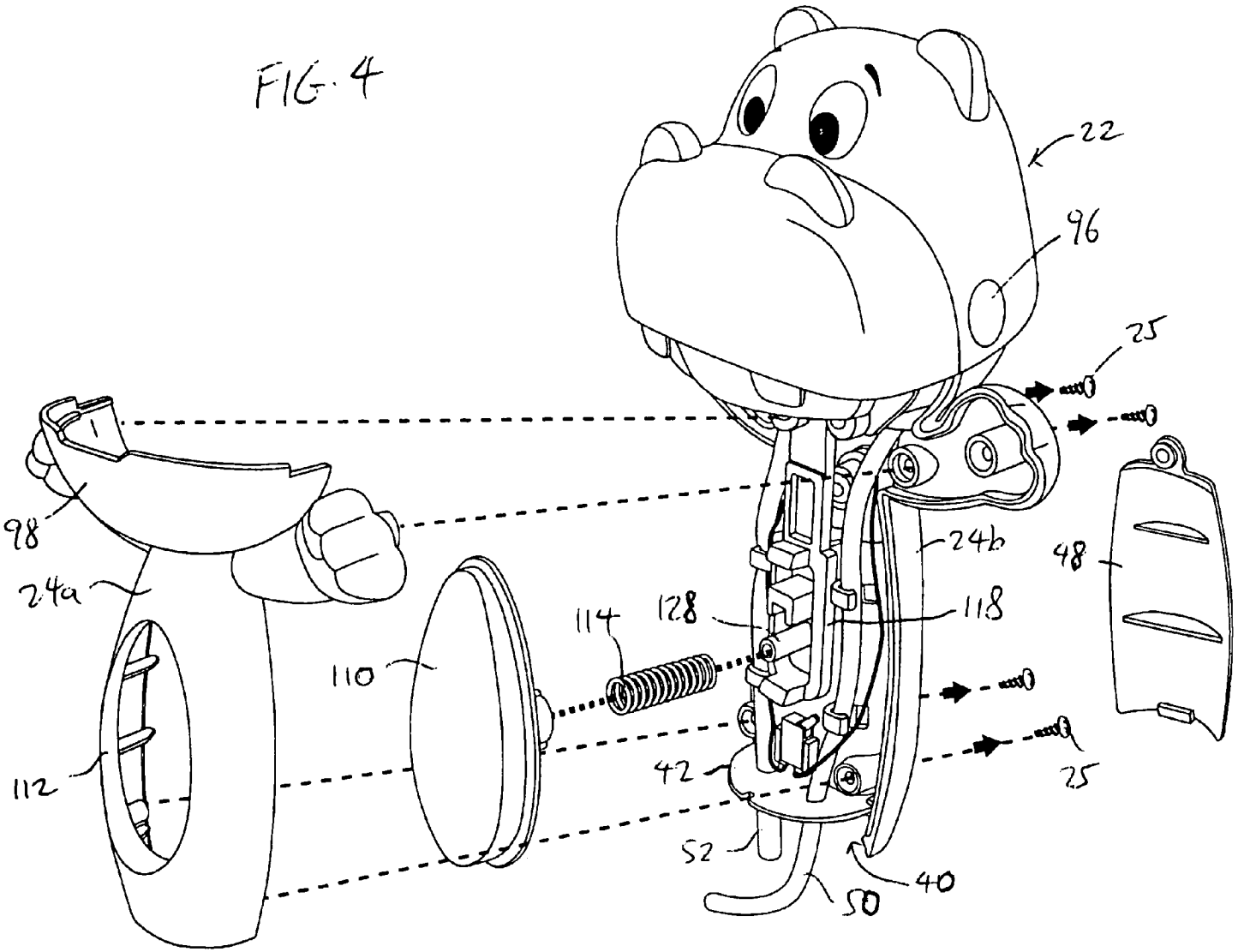
FIG. 4 is an exploded perspective view of the assembly of FIG. 1.
Figure 5:
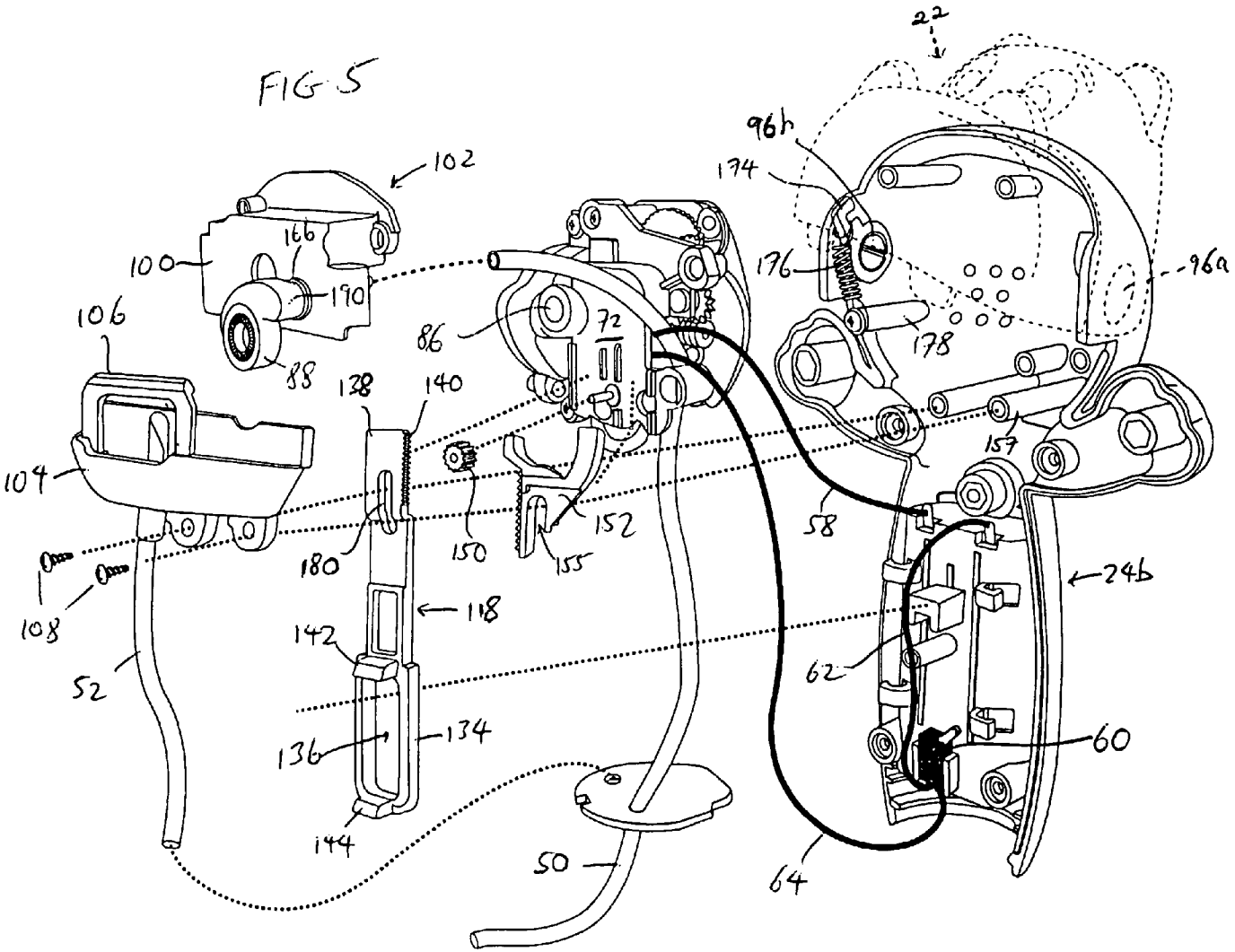
FIG. 5 is another exploded perspective view of the assembly of FIG. 1 showing different components thereof.

FIGS. 1-10B illustrate one embodiment of a bubble generating assembly 20 according to the present invention. The assembly 20 has a housing that includes a head section 22, a body housing 24 and a feet section 26. The feet section 26 functions as a base section, and these two terms are used interchangeably herein. The combined housing can assume any shape, including an animal shape as shown in FIG. 1. The body housing 24 can be provided in the form of a front shell 24*a* and a rear shell 24*b* (as best shown in FIGS. 4 and 5) that are connected together by, for example, screws (e.g., screws 25) or welding or glue. These shells 24*a*, 24*b* together define a hollow interior for housing the internal components of the assembly 20, as described below.

Figure 6B:
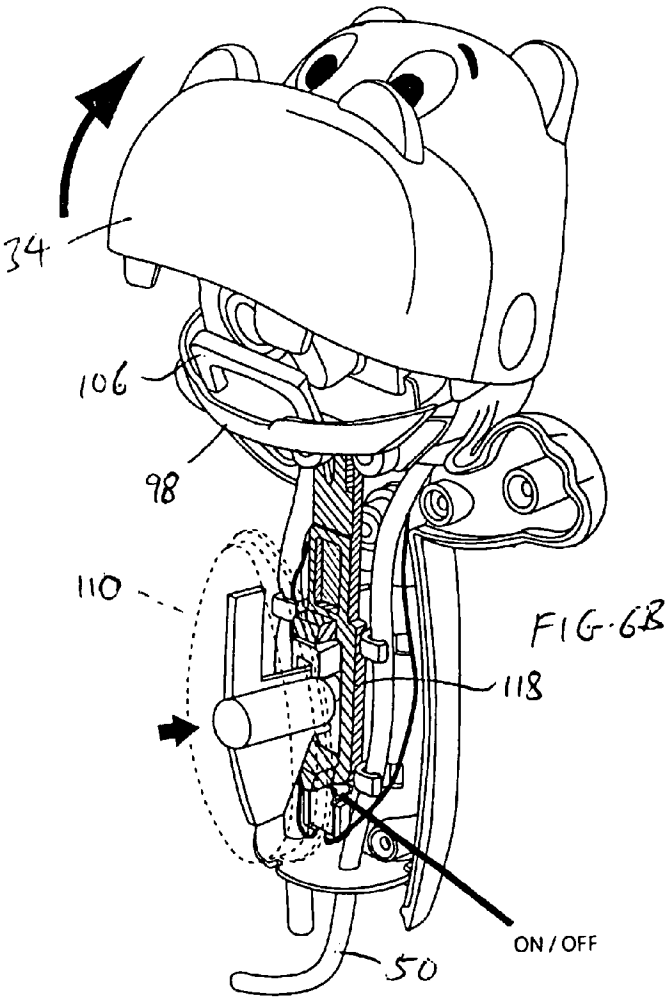
FIGS. 6A and 6B are partial views of the assembly of FIG. 1 illustrating the operation of certain components.
Figure 6A:
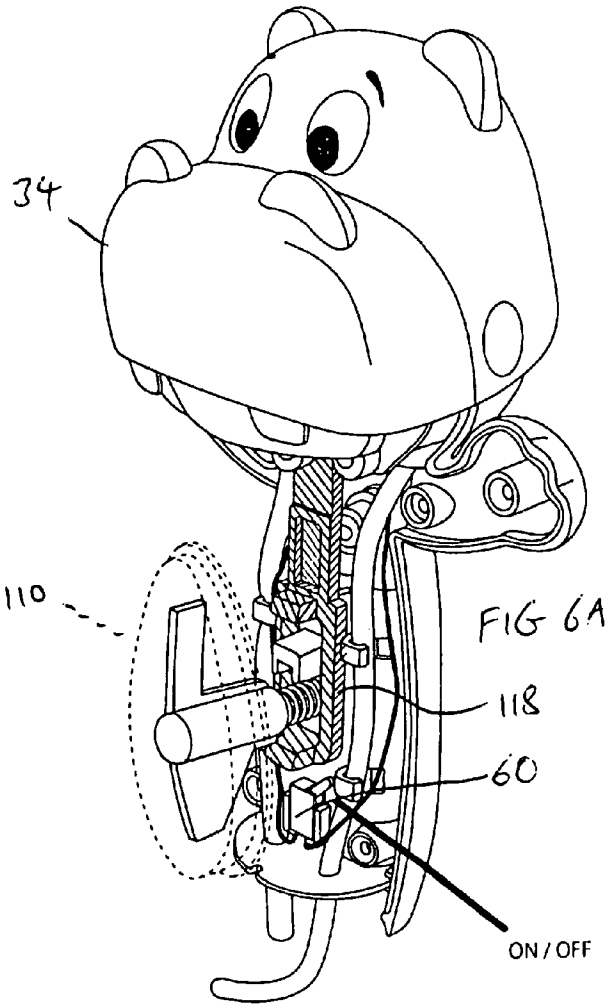
Figure 7B:
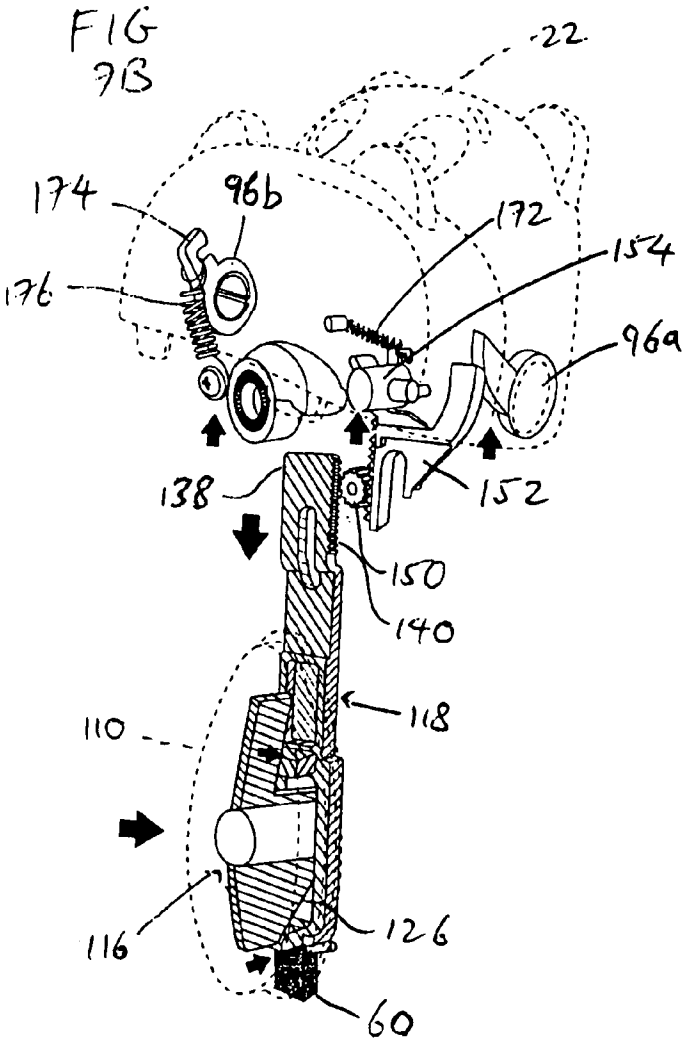
FIGS. 7A and 7B are partial views of the assembly of FIG. 1, corresponding to FIGS. 6A and 6B, illustrating the operation of other components.
Figure 7A:
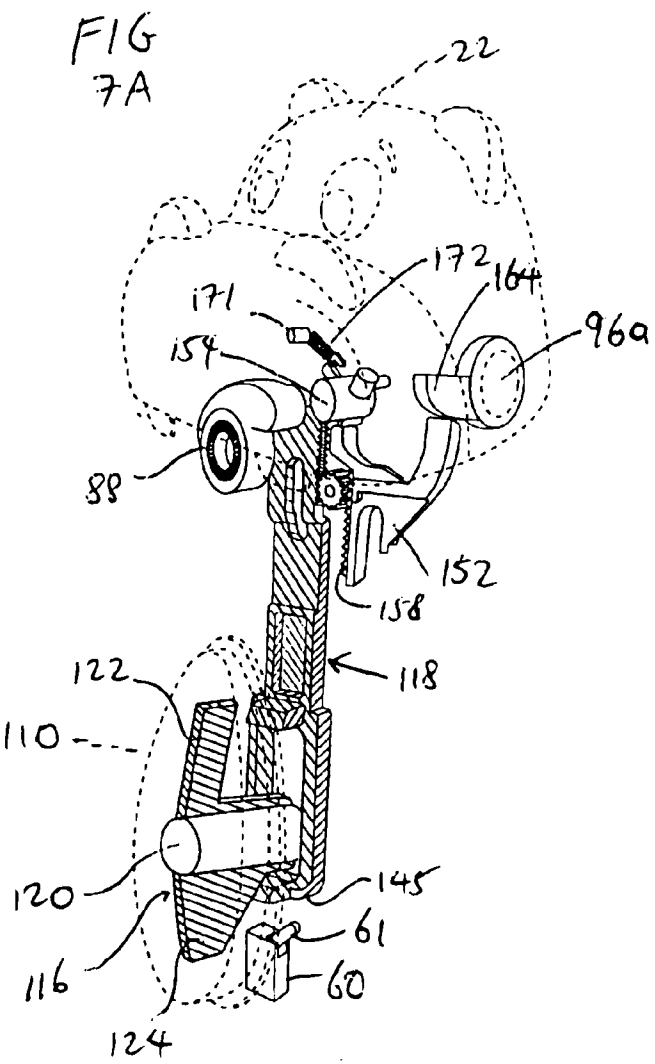

The head section 22 can be a head-shaped shell that pivots about the top part of the rear shell 24*b* (see FIG. 5) via a pair of hinged screws 96*a*, 96*b*, as described in greater detail below. A bubble generating space is defined between the head section 22 and the jaw section 98 at the upper end of the front shell 24*a*. The jaw section 98 and the head section 22 are together configured to resemble the head of the desired animal, and can include include eyes 30, ears 32, and an upper jaw portion 34 which covers a bubble generating ring 88 (hereinafter "ring 88") seated in the bubble generating space. However, the mouth of the animal is defined by the space created when the head section 22 is pivoted upwardly from the jaw section 98 (which is stationary). FIG. 6A illustrates the mouth closed, with the head section 22 seated on top of the jaw section 98, while FIGS. 1 and 6B illustrate the mouth opened with the head section 22 pivoted upwardly from the jaw section 98.

The feet section 26 is configured as the feet of the animal, and is actually a reservoir or container which holds bubble solution while also acting as a base for the assembly 20. The top of the feet section 24 has a generally annular threaded stem 36 which defines an opening 38 into which bubble solution can be introduced. The threaded stem 36 is adapted to threadably engage a threaded bottom opening 40 of the body housing 24 to removably attach the feet section 26 to the bottom of the body housing 24 (see FIG. 4). A bottom wall 42 is provided adjacent the bottom opening 40 of the body housing 24 to prevent the bubble solution from spilling into the internal components housed inside the body housing 24. A first delivery tubing 50 extends from the interior of the feet section 26 through an opening in a bottom wall 42 and into the body housing 24. A second feedback tubing 52 extends from inside the jaw portion 34, through the body housing 24 and an opening in the bottom wall 42, back into the feet section 26.

Referring to FIG. 2, a battery compartment 44 is provided in the rear shell 24*b* for holding batteries 46, which constitutes the power source. The power source can also be embodied in the form of an electrical plug that can be connected to an electrical outlet in the wall of a house. A battery cover 48 can be screwed to the rear surface of the rear shell 24*b* to cover the battery compartment 44.

Figure 9:
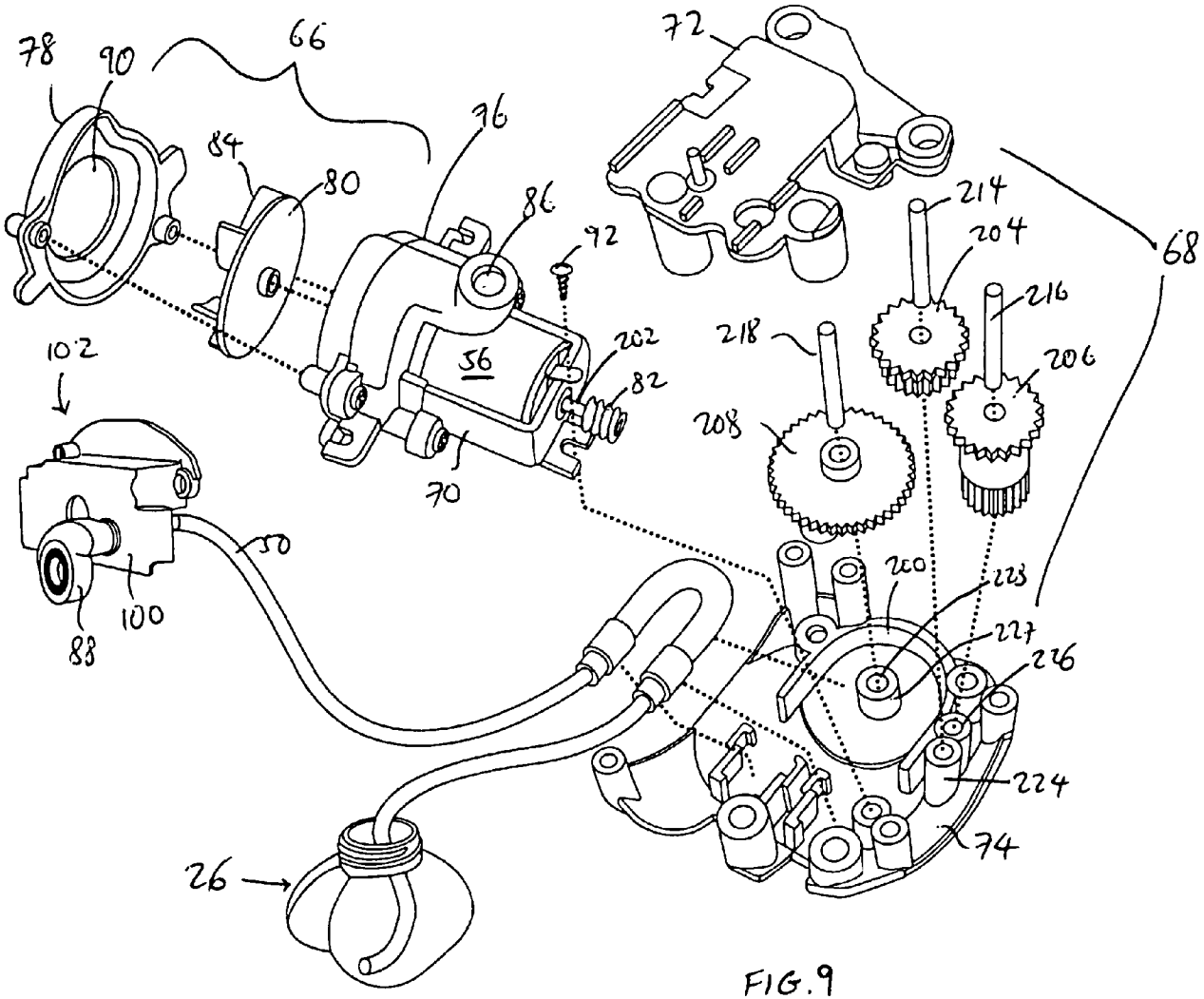
FIG. 9 is an exploded perspective view of the gear system and pump system of FIG. 1.

A switch 60 is provided in the rear shell 24*b* adjacent the bottom wall 42. The switch 60 has an arm 61 that is actuated to turn on the switch 60 (see FIG. 7A). Referring also to FIGS. 5 and 9, a motor 56 is electrically coupled to the power source via a first wire 58. A second wire 62 couples the power source to the switch 60. A third wire 64 couples the switch 60 to the motor 56. The motor 56 is received in a motor mount 70 that is connected to a fan housing 66. The combined motor mount 70 and fan housing 66 is in turn mounted onto to a gear and pump housing 68. The gear and pump housing 68 includes a top plate 72 and a bottom plate 74 that together define an interior space for receiving the gear system and the pump system described below. The fan housing 66 includes a fan support base 76 and an upper housing 78 that are secured together (e.g., via screws) to define an interior space for receiving an air generator 80 (e.g., a fan). The motor 56 is mounted inside the motor mount 70 to the fan support base 76, and an opening is provided in the bottom part of the motor mount 70 to allow a shaft of the motor gear 82 of the motor 56 to extend through into the interior of the gear and pump housing 68 to operatively engage a gear 204 of the pump system. Similarly, an opening (not shown) is provided in the fan support base 76 to allow another shaft (not shown) of the motor 56 to extend therethrough to operatively couple the fan 80, to allow the motor 56 to rotate the fan 80 and its blades 84. An opening 90 in the upper housing 78 allows air to be directed to the fan 80. A channel (not shown) connects the fan 80 to an air opening 86 in the side wall of the fan support base 76 to allow air generated by the fan 80 to be directed towards the ring 88.

The gear and pump housing 68 and the motor mount 70 are secured to the bottom plate 74 by screws 92 (see FIG. 9). The bottom plate 74 is in turn secured to an inner wall of the rear shell 24*b* by other screws (e.g., see 25 in FIG. 4). Referring to FIG. 5, the ring 88 is carried on a front panel 100 of a ring mount 102 that is coupled to a rotating piece 154 of a pivot linkage inside of the jaw portion 34. A collector 104 is secured to the inside of the jaw section 98 by screws 108. The collector 104 is shaped like a receiving trough to collect and receive droplets of bubble solution that have dripped from the ring 88, and to deliver these droplets of bubble solution back into the interior of the feet section 26 via the tubing 52. A stationary wiping member 106 extends vertically from about the front center of the collector 104, and has an inverted U-shape bar that is positioned in front of the ring 88 and oriented in a manner so that the ring 88 brushes against the rear surface of the wiping member 106 when the jaw portion 34 is pivoted upwardly or downwardly. The wiping member 106 can be slightly curved.

A pump system (described in greater detail below) is operatively coupled to the motor 56 and an actuator 110. Referring also to FIGS. 4, 6A, 6B, 7A and 7B, the actuator 110 can be an enlarged button that resembles the belly or stomach of the animal and extends through an opening 112 in the front shell 24*a*. The actuator 110 is part of the actuation mechanism which also includes a spring 114, a guide member 116, and a vertical link 118. The guide member 116 is secured to the inner surface of the button actuator 110, and has a cylindrical section 120, an upper fin 122 positioned above the cylindrical section 120, and a lower fin 124 positioned below the cylindrical section 120. The lower fin 124 has an angled inner edge 126. The spring 114 is carried on a post 128 that extends from the inner surface of the rear shell 24*b*, and the spring 114 is received inside the hollow bore (not shown) of the cylindrical section 120. The vertical link 118 has a lower section 134 that defines a generally rectangular opening 136, and an upper section 138 that has a toothed edge 140 along a side edge thereof. The screws 108 also extend through an elongated vertical opening 180 in the link 118. An upper ridge 142 is provided above the rectangular opening 136 facing the actuator 110, and a lower ridge 144 is provided below the rectangular opening 136 facing the actuator 110. The lower ridge 144 has an angled front edge that is angled inversely to the angle of the angled inner edge 126 of the lower fin 124, and which normally rest against each other. The cylindrical section 120 (and the spring 114 housed therein) as well as a portion of the lower fin 124 are adapted to extend through the rectangular opening 136. When the actuator 110 is pressed against the normal bias of the spring 114, the cylindrical section 120 and the lower fin 124 are pushed inwardly through the rectangular opening 136. As the lower fin 124 enters the rectangular opening 136, the angled inner edge 126 slides along the angled front edge of the lower ridge 144, thereby pressing the lower ridge 144 (and the vertical link 118) downwardly, as shown in FIGS. 6A, 6B, 7A and 7B, until the bottom curved part 145 of the lower section 134 adjacent the lower ridge 144 presses the arm 61 of the switch 60, causing the switch 60 to be turned on. In addition, the upper ridge 142 acts as a stop member to limit the inward movement of the actuator 110.

The upper section 138 is operably connected to a pivot linkage via the toothed edge 140. Referring to FIGS. 7A, 7B, 8A and 8B, the pivot linkage includes a drive gear 150, a Y-shaped pusher piece 152, a rotating block 154, and one of the hinged screws 96*a*. The pusher piece 152 has a stem 156 with a toothed side 158 that faces the toothed edge 140, and two branching upper ends 160 and 162. Referring to FIG. 5, the pusher piece 152 has a lower slot 155 that receives a post 157 to pivotably support the pusher piece 152 to the rear shell 24*b*, with one of the screws 108 inserted through the front shell 24*a* into a threaded bore in the post 157. The drive gear 150 is rotatably secured to a shaft extending from the plate 72, and engages the toothed edge 140 and the toothed side 158 to engageably couple the vertical link 118 and the pusher piece 152. One branching upper end 160 is adapted to push the rotating block 154, and the other branching upper end 162 is adapted to push an extension 164 of the hinged screw 96*a*. The rotating block 154 is secured to a tubular channel 190 (that leads to the ring 88) via a bore 166 of the ring mount 102. The rotating block 154 also has an extension 168 and a hook 170. A spring 172 has opposing ends connected to the hook 170 and a post 171 in the inner surface of the jaw portion 34.

The opposite hinged screw 96*b* has a hooked extension 174, with a spring 176 having opposing ends connected to the hooked extension 174 and a post 178 extending from the inner surface of the rear shell 24*b*.

Figure 8B:
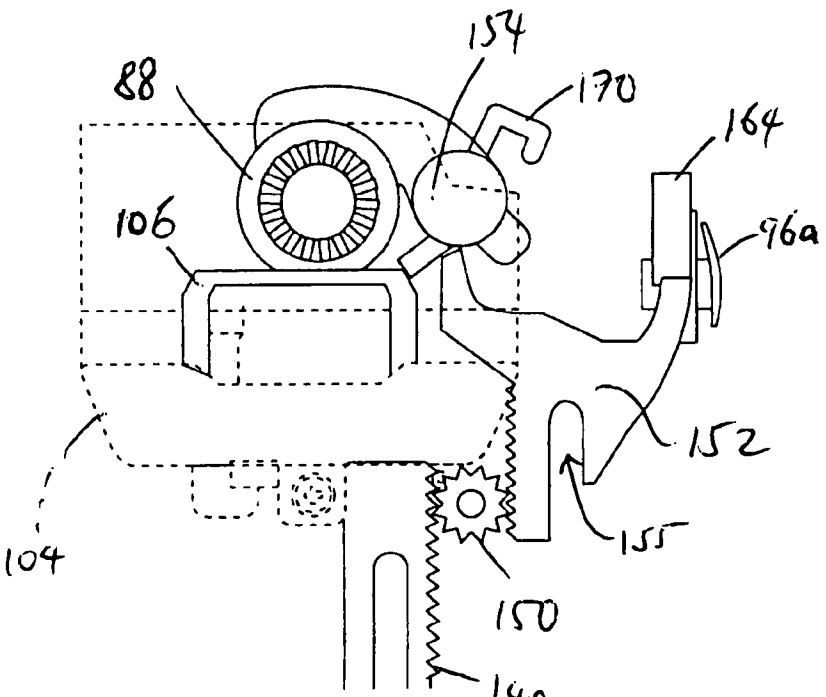
FIGS. 8A and 8B are partial views of the assembly of FIG. 1, corresponding to FIGS. 7A and 7B, illustrating the operation of other components.
Figure 8A:
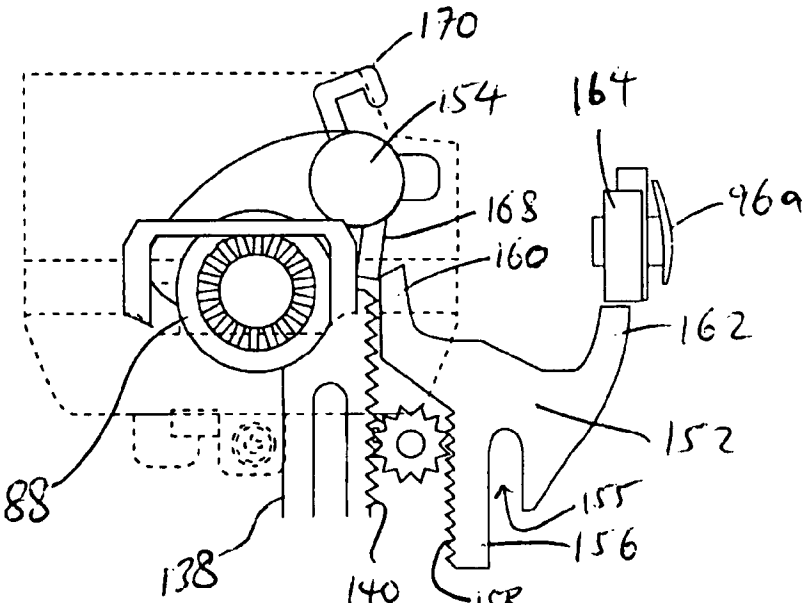

When the fin 124 pushes the link 118 downwardly, the drive gear 150 rotates counterclockwise (as viewed from a frontal orientation as shown in FIGS. 8A and 8B), thereby causing the pusher piece 152 to move upwardly. As the pusher piece 152 moves upwardly, the branching upper end 162 pushes the extension 164 upwardly, causing the hinged screw 96*a* to pivot and push the jaw portion 34 upwardly to open the mouth of the assembly 20. At the same time, the branching upper end 160 pushes the extension 168, causing the rotating block 154 to rotate clockwise (as viewed from a frontal orientation as shown in FIGS. 8A and 8B), thereby moving the ring mount 102 (and its ring 88) upwardly in a curved clockwise motion (since the rotating block 154 is secured to the channel 190). The ring 88 moves across the wiping member 106 (compare FIGS. 8A and 8B) to a raised position where it is aligned with the air opening 86. The clockwise rotation of the hook 170 will also extend the spring 172 to create a bias. As the jaw portion 34 is raised to open the mouth, the hooked extension 174 will also extend the spring 176 to create a bias. As long as the user keeps pressing on the actuator 110, the pusher piece 152 will maintain the jaw portion 34 and the ring 88 raised to keep generating bubbles.

When the user releases the actuator 110, the spring 114 biases the actuator 110 outward, so that the fin 124 slides outwardly away from the rectangular opening 136. The spring 172 biases the hook 170 to cause the rotating block 154 to rotate counterclockwise (as viewed from a frontal orientation as shown in FIGS. 8A and 8B), causing the extension 168 to push the branching upper end 160 (and the pusher piece 152) downwardly. At the same time, the spring 176 biases the hooked extension 174 downwardly, causing the hinged screw 96*b* to pivot so as to pull the jaw portion 34 down to close the mouth. The pivoting of the jaw portion 34 pivots the other hinged screw 96*a* to cause the extension 164 to push the branching upper end 162 (and the pusher piece 152) downwardly. As the pusher piece 152 moves down, the drive gear 150 rotates clockwise (as viewed from a frontal orientation as shown in FIGS. 8A and 8B), thereby causing the link 118 to move upwardly. The link 118 is able to move up because the fin 124 has been retracted from the rectangular opening 136 so that the angled front edge of the lower ridge 144 can slide along the angled edge 126 of the fin 124. As the rotating block 154 rotates clockwise, it causes the ring 88 and the ring mount 102 to rotate in a curved counterclockwise motion (since the rotating block 154 is secured to the channel 190), so that the ring 88 moves back across the wiping member 106 to its original rest position shown in FIG. 8A.

The construction of the ring 88 can be the same as that illustrated in FIG. 15 of U.S. Pat. No. 6,616,498, whose disclosure is incorporated by this reference as though set forth fully herein. The ring 88 has an annular base piece that has a cylindrical wall extending therein to define an annular chamber therein. An opening is provided in the base piece. The ring 88 also has an annular cover piece that fits into the annular chamber of the base piece. A plurality of outlets can be provided along the inner annular surface, and/or the front surface, of the cover piece. The tubular channel 190 extends from the front panel 100 and communicates with the annular chamber of the ring 88. The tubing 50 extends through the channel 190 to deliver bubble solution from the feet section 26 into the annular chamber of the ring 88. The bubble solution from the annular chamber can then leak out of the outlets onto the front surface of the ring 88.

Referring now to FIGS. 5, 9, 10A and 10B, the assembly 20 includes a pump system that functions to pump the bubble solution from the feet section 26 to the ring 88. The pump system includes the motor 56, the tubing 50, a guide wall 200, and a gear system that functions to draw bubble solution through the tubing 50. The gear system includes a motor gear 82 that is rotatably coupled to a shaft 202 of the motor 56, a first gear 204, a second gear 206, a third gear 208, and two pressure rollers 210 and 212 that are secured to the bottom surface of the third gear 208. Gear shafts 214, 216 and 218 extend from the plate 72 through bores in the gears 204, 206 and 208, respectively, and into receiving bores 224, 226 and 228, respectively, provided on the plate 74, to rotatably connect the gears 204, 206 and 208 to the plates 72 and 74.

The motor gear 82 has teeth that are engaged with the teeth of the first gear 204. The first gear 204 has teeth that are engaged with the teeth of the second gear 206, and the second gear 206 has teeth that are engaged with the teeth of the third gear 208. The third gear 208 rotates about an axis defined by the shaft 218. The pressure rollers 210, 212 are spaced apart along the outer periphery of the third gear 208. Each pressure roller 210, 212 has a truncated cone configuration which has a largest diameter at a base section where the roller 210, 212 is connected to the third gear 208, with the diameter decreasing to a smallest diameter at an end at its furthest distance from the third gear 208. The tubing 50 is received inside the guide wall 200 and is looped around the post 227 that defines the bore 228.

The pump system operates in the following manner. When the actuator 110 is pressed, the switch 60 is turned on in the manner described above to cause the motor 56 to be actuated. When the motor 56 is actuated, the motor gear 56 will rotate, thereby causing the gears 204, 206 and 208 to rotate as well. As the third gear 208 rotates, the rollers 210, 212 will also rotate because they are carried by the third gear 208. As the rollers 210, 212 rotate, they will apply selected pressure on different parts of the tubing 50 in the manner described below to draw bubble solution from the feet section 26 to the ring 88. At the same time, actuation of the motor 56 will rotate the fan blades 84 to cause air to be generated and delivered from the air opening 86.

FIGS. 10A, 10B, 11A and 11B illustrate the operation of the pressure rollers 210, 212 in greater detail. FIGS. 10A and 11A illustrate the relationship between the pressure rollers 210, 212 and the tubing 50 when the assembly 20 is in the normal non-operational condition, and FIGS. 10B and 11B illustrate the relationship between the pressure rollers 210, 212 and the tubing 50 when the assembly 20 is in the actuated (i.e., bubble-generating) position. As shown in FIGS. 10A and 11A, the tubing 50 is normally fitted between the guide wall 200 and the post 227, with the pressure roller 210 compressing the tubing 50 but the pressure roller 212 not contacting the tubing 50. When the motor 56 is actuated, the motor gear 56 will rotate, thereby causing the gears 204, 206 and 208 to rotate as well. As the third gear 208 rotates, the rollers 210, 212 will also rotate because they are carried by the third gear 208. As the third gear 208 rotates, both rollers 210, 212 will compress the tubing 50 at selected times (see FIGS. 10B and 11B), and only one of the two rollers 210 or 212 (see FIGS. 10A and 11A) will contact the tubing 50 at other selected times, thereby creating a pressure differential that will draw the bubble solution from the interior of the feet section 26 through the tubing 50 into the annular chamber of the ring 88, where the bubble solution will bleed out through the outlets on to the front surface of the ring 88.

The assembly 20 operates in the following manner. In the normal (non-operational) position, which is illustrated in FIGS. 4, 6A, 7A and 8A, the ring 88 is positioned behind the wiping member 106 inside the mouth. In this normal position, the spring 114 normally biases the actuator 110 outwardly, and the spring 176 normally biases the jaw portion 34 down to close the mouth and cover the ring 88.

The assembly 20 is actuated merely by pressing the actuator 110 inwardly to overcome the natural bias of the spring 114, and causes the link 118 to be pushed downwardly, causing the following sequences of events occur at about the same time.

First, the bottom end of the link 118 contacts the arm 61 of the switch 60 to turn on the switch 60, actuating the motor 56, which causes bubble solution to be pumped from the feet section 26 to the ring 88, and air to be generated and delivered through the air opening 86, in the manners described above.

Second, the pusher piece 154 is raised, which simultaneously causes the jaw portion 34 to be raised to open the mouth, and the ring 88 to be moved across the wiping member 106 to be aligned with the air opening 86, in the manners described above. The wiping motion of the wiping member 106 along the front surface of the ring 88 will generate a film of bubble solution (from the bubble droplets emitted from the outlets) that extends across the opening of the ring 88. The stream of air from the air opening 86 will travel through the film of bubble solution that has been formed over the ring 88, thereby creating bubbles. See FIGS. 1, 6B, 7B and 8B.

When the user releases the actuator 110, the spring 114 will normally bias the actuator 110 back outwardly, causing the following sequence of events to occur.

The normal bias of the springs 172 and 176 will lower the jaw portion 34 and rotate the rotating block 154 counterclockwise, causing the mouth to close and the pusher piece 152 to be lowered. As the pusher piece 152 is lowered, the link 118 is raised, causing the switch 60 to be opened or disengaged. Disengaging the switch 60 will turn off the motor 56, causing the pump system to stop drawing bubble solution from the feet section 26 to the ring 88. Disengaging the switch 60 will also cause the fan 80 to stop producing streams of air. In addition, counterclockwise rotation of the rotating block 154 will cause the ring 88 to travel in a downward curved path as the front surface of the ring 88 wipes across the stationary wiping member 106, back to the normal (non-operation) position shown in FIGS. 4, 6A, 7A and 8A.

Thus, the present invention provides a bubble generating assembly 20 that is small and compact in configuration, yet can effectively produce streams of bubbles while being configured in the aesthetic shape of a cute toy animal. The middle or center of the assembly can be the body or stomach housing 24, and is configured to function as both a handle (see FIG. 1) and as a trigger, while housing the important linkages of the assembly 20. In addition, the feet section 26 can be configured as the feet of the toy animal while also functioning as a reservoir for the bubble solution. By providing the feet section 26 and the body housing 24 as functional components, the overall size and configuration of the assembly 20 can be kept compact while ensuring that the mechanisms needed generate effective streams of bubbles can be maintained.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly, comprising:

a head section having a bubble generator associated therewith;

a body housing that houses a motor and an air generator coupled to the motor, the outer surface of the body housing defining a handle for the assembly, and having an actuator provided on the outer surface of the body housing;

a feet section that is configured as a reservoir for holding bubble solution; and a pump system provided inside the body housing that draws bubble solution from the feet section to the bubble generator;

wherein the feet section is removably connected to a bottom part of the body housing, with a tubing extending from inside the feet section through the interior of the body housing.

2. The assembly of claim 1, wherein the head section includes a pivotable upper jaw portion that covers the bubble generator.

3. The assembly of claim 1, further including a gear system that is operably coupled to the motor and the pump system.

4. The assembly of claim 1, wherein the bubble generator includes a housing that defines a chamber for receiving the bubble solution, with the opening provided in the housing, and through which solution received in the chamber may flow.

5. The assembly of claim 1, further including a collector positioned adjacent the bubble generator to collect and receive droplets of bubble solution that have dripped from the bubble generator.

6. The assembly of claim 1, wherein the air generator is fluidly coupled to an air opening that is aligned with the bubble generator when the bubble generator is moved across the wiping bar.

7. A bubble generating assembly, comprising:

a head section having a bubble generator associated therewith;

a body housing that houses a motor and an air generator coupled to the motor, the outer surface of the body housing defining a handle for the assembly, and having an actuator provided on the outer surface of the body housing;

a feet section that is configured as a reservoir for holding bubble solution; and a pump system provided inside the body housing that draws bubble solution from the feet section to the bubble generator;

further including a jaw section provided at the upper end of the body housing, and a stationary wiping member provided on the jaw section, and wherein the bubble generator is positioned behind the wiping member, and moves across the wiping member to create a film of bubble solution across the bubble generator.

8. The assembly of claim 7, wherein pressing the actuator causes the bubble generator to move across the wiping member to a bubble generating position.

9. The assembly of claim 8, wherein the air generator is fluidly coupled to an air opening that is aligned with the bubble generator when the bubble generator is moved to the bubble generating position.

10. A bubble generating assembly, comprising:

a head section having a bubble generator associated therewith;

a body housing that houses a motor and an air generator coupled to the motor, the outer surface of the body housing defining a handle for the assembly, and having an actuator provided on the outer surface of the body housing;

a feet section that is configured as a reservoir for holding bubble solution; and a pump system provided inside the body housing that draws bubble solution from the feet section to the bubble generator;

wherein the head section includes a pivotable upper jaw portion that covers the bubble generator, and wherein pressing the actuator causes the head section to be pivoted upwardly to expose the bubble generator, and the bubble generator to move across the wiping member to a bubble generating position.

11. A bubble generating assembly, comprising:

a head section having a bubble generator associated therewith;

a body housing that houses a motor and an air generator coupled to the motor, the outer surface of the body housing defining a handle for the assembly, and having an actuator provided on the outer surface of the body housing;

a feet section that is configured as a reservoir for holding bubble solution; and a pump system provided inside the body housing that draws bubble solution from the feet section to the bubble generator;

further including a vertical link inside the body housing, wherein the vertical link is coupled to the actuator such that pressing the actuator causes the actuator to move downwardly, actuating an electrical switch in the body housing and pushing a pusher piece upwardly to cause the bubble generator to move across the wiping member.

12. The assembly of claim 11, wherein the head section includes a pivotable upper jaw portion that covers the bubble generator.

13. The assembly of claim 11, further including a gear system that is operably coupled to the motor and the pump system.

14. The assembly of claim 11, wherein the bubble generator includes a housing that defines a chamber for receiving the bubble solution, with the opening provided in the housing, and through which solution received in the chamber may flow.

15. The assembly of claim 11, wherein the air generator is fluidly coupled to an air opening that is aligned with the bubble generator when the bubble generator is moved across the wiping bar.

16. The assembly of claim 11, further including a collector positioned adjacent the bubble generator to collect and receive droplets of bubble solution that have dripped from the bubble generator.

17. A bubble generating assembly in the shape of an animal standing upright, comprising:

a head section having a bubble generator associated therewith;

a body housing that houses a motor and an air generator coupled to the motor, a mid-section of the body housing defining a handle for the assembly, and having an actuator provided on the front of the mid-section of the body housing;

a base section that is configured as a reservoir for holding bubble solution; and a pump system provided inside the body housing that draws bubble solution from the base section to the bubble generator, the pump system including tubing that extends from the base section to the bubble generator;

wherein the base section is removably coupled to a bottom part of the body housing.

18. The assembly of claim 17, further including a vertical link inside the mid-section of the body housing adjacent the handle, wherein the vertical link is coupled to the actuator such that pressing the actuator activates the motor and the air generator.

* * * * *